US011362469B1

(12) United States Patent
Xu

(10) Patent No.: US 11,362,469 B1
(45) Date of Patent: Jun. 14, 2022

(54) LAMP SOCKET STRUCTURE

(71) Applicant: Hangzhou Kaite Electrical Appliance Co., Ltd., Jiande (CN)

(72) Inventor: Chao Xu, Jiande (CN)

(73) Assignee: HANGZHOU KAITE ELECTRICAL APPLIANCE CO., LTD., Jiande (CN)

( * ) Notice: Subject to any disclaimer, the term of this patent is extended or adjusted under 35 U.S.C. 154(b) by 0 days.

(21) Appl. No.: 17/234,155

(22) Filed: Apr. 19, 2021

(30) Foreign Application Priority Data

Mar. 8, 2021 (CN) ..... 202120490210.9

(51) Int. Cl.
*H01R 33/22* (2006.01)
*F21V 19/00* (2006.01)
*H01R 33/06* (2006.01)

(52) U.S. Cl.
CPC ..... *H01R 33/22* (2013.01); *F21V 19/006* (2013.01); *H01R 33/06* (2013.01)

(58) Field of Classification Search
CPC ..... H01R 33/22; H01R 33/225; H01R 33/05; H01R 33/06; F21V 19/006
See application file for complete search history.

(56) References Cited

U.S. PATENT DOCUMENTS 7,654,854 B1 * 2/2010 Yang ..... H01R 33/18 439/602

10,897,113 B1 * 1/2021 Yu ..... F21V 23/06

* cited by examiner

*Primary Examiner* — Oscar C Jimenez
*Assistant Examiner* — Paul D Baillargeon
(74) *Attorney, Agent, or Firm* — Muncy, Geissler, Olds & Lowe, P.C.

(57) ABSTRACT

The present disclosure provides to a lamp socket structure. The lamp socket structure includes a plastic outer housing, a metal inner housing, an insulating bottom plate, a live-wire metal connecting piece, and a neutral-wire metal connecting piece, wherein the metal inner housing is in a cylindric structure, a receiving chamber configured to receive a lamp cap is disposed inside the metal inner housing, a positioning chamber having a small upper portion and a large lower portion vertically runs through a top portion of the metal inner housing, the live-wire metal connecting piece is plugged into the two matting columns, a riveting head is integrally and protrusively fixed to both a top portion of the live-wire metal connecting piece and a top portion of the neutral-wire metal connecting piece, the riveting head being in a U-shaped plate structure; and the metal inner housing, the insulating bottom plate, the live-wire metal connecting piece, and the neutral-wire metal connecting piece constitute a conducting base for conduction of the lamp cap, the plastic outer housing being mounted to the conducting base by an injection molding process. The lamp socket structure is reasonable in design, and may prevent poor contacts at a wire junction due to high temperature at the lamp cap when the wire is mounted. Therefore, this lamp socket structure is suitable to promotion and application.

5 Claims, 5 Drawing Sheets

LAMP SOCKET STRUCTURE

TECHNICAL FIELD

The present disclosure relates to the technical field of lamp socket technologies, and in particular, relates to a lamp socket structure.

BACKGROUND

A traditional lamp cap includes a housing, a metal spiral opening, an insulating plate configured to insulate a neutral wire from a live wire, and a live-wire cap, wherein the live-wire cap is mounted into the insulating plate, and then a spring is mounted into the live-wire cap. One end of the spring is connected to the live-wire cap, the other end of the spring is connected to a metal cover plate. The metal cover plate is connected to a live wire of a power wire by soldering tin to a surface. A surface of the metal spiral opening of the lamp cap is connected to a neutral wire of the power wire by tin soldering.

An electrical connection in such structure is not mechanically secured, and is only lapped on a surface by tin soldering. In this way, with environment changes of thermal expansion and contraction, the connection is easily subject to poor contact and drop, and safety hazards may be caused to users.

SUMMARY

Embodiments of the present disclosure intend to provide a lamp socket structure, to solve the above technical problem.

To achieve the above object, the present disclosure employs the following technical solution. A lamp socket structure includes a plastic outer housing, a metal inner housing, an insulating bottom plate, a live-wire metal connecting piece, and a neutral-wire metal connecting piece, wherein the metal inner housing is in a cylindric structure, a receiving chamber configured to receive a lamp cap is disposed inside the metal inner housing, a positioning chamber having a small upper portion and a large lower portion vertically runs through a top portion of the metal inner housing, a plurality of positioning holes are disposed on an outer edge, corresponding to the positioning chamber, of the top portion of the metal inner housing, a via hole protruding column is integrally disposed on an outer edge, corresponding to one positioning hole, of the top portion of the metal inner housing, and the neutral-wire metal connecting piece is fixed to the via hole protruding column by interference fitting;

the insulating bottom plate is in a disc-shaped structure, an insulating enclosure having a small upper portion and a large lower portion and plugged into the positioning chamber is integrally disposed in a center of a top portion of the insulating bottom plate, a plurality of plug columns plugged into the positioning holes by interference fitting are integrally disposed in an outer edge of the top portion of the insulating bottom plate, and the insulating bottom plate is plugged into the top portion of the metal inner housing;

wherein a plug hole is disposed in a center of the insulating enclosure, an elastic assembly being plugged into the plug hole, and two vertical matting columns are symmetrically fixed to two sides of the plug hole in the insulating enclosure, the live-wire metal connecting piece being plugged into the two vertical matting columns;

a riveting head is integrally and protrusively fixed to both a top portion of the live-wire metal connecting piece and a top portion of the neutral-wire metal connecting piece, the riveting head being in a U-shaped plate structure; and the metal inner housing, the insulating bottom plate, the live-wire metal connecting piece, and the neutral-wire metal connecting piece constitutes a conducting base for conduction of the lamp cap, the plastic outer housing being mounted to the conducting base by an injection molding process.

Preferably, the plastic outer housing is in a cylindric structure, and a wire is mounted on a top portion of the plastic outer housing, where the wire is fixed to the plastic outer housing by the injection molding process.

Preferably, the elastic assembly includes a metal cap and an ejecting spring, wherein the metal cap is plugged into the plug hole, an extending chamber is opened on a top portion of the metal cap, the ejecting spring is disposed in the extending chamber, and a top portion of the ejecting spring is abutted against a bottom of the live-wire metal connecting piece.

Preferably, the plurality of positioning holes are annularly arrayed around an axis of the metal inner housing, and the plurality of plug columns are annularly arrayed around a point of circle of the insulating bottom plate.

Preferably, a thread groove mating and nesting with a mounting chamber is disposed on an outer side of the metal inner housing, and a female thread for threading the lamp cap is disposed in the receiving chamber.

Embodiments of the present disclosure may achieve such technical effects and advantages: in the lamp socket structure, a U-shaped riveting head is integrally fixed to both a top portion of the live-wire metal connecting piece and a top portion of the neutral-wire metal connecting piece, and the wire may be riveted by the U-shaped riveting head during the mount, which prevents the wire from being fixed by solder, and prevents poor contact and wire drop at a wire junction due to high temperature at the lamp cap. By disposing an insulating bottom plate, plug columns on the insulating bottom plate mates with positioning holes on a metal inner housing, which facilitates cooperation and securing between the insulating bottom plate and the metal inner housing, and an insulating enclosure disposed on the insulating bottom plate may ensure that the live-wire metal connecting piece is not in contact with the neutral-wire metal connecting piece, which effectively prevents the problems, such as, short circuits caused by overlapping between the live-wire and the neutral-wire. The lamp socket structure is reasonable in design, and may prevent poor contacts at a wire junction due to high temperature at the lamp cap when the wire is mounted. Therefore, this lamp socket structure is suitable to promotion and application.

Figure 1:
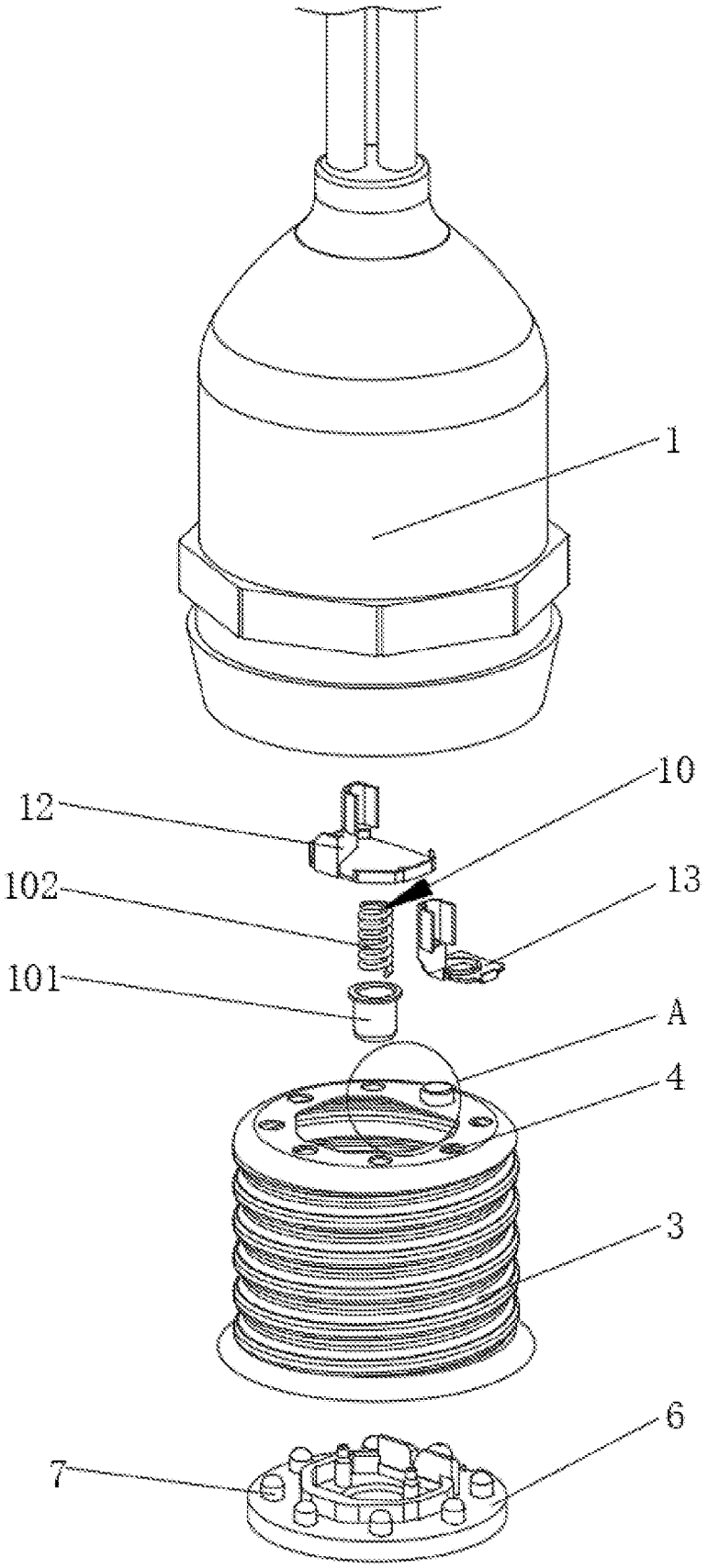
FIG. 1 is a schematic view of disassembling of a lamp socket structure according to the present disclosure.

In the drawings: 1—plastic outer housing, 2—wire, 3—metal inner housing, 4—positioning hole, 5—via hole protruding column, 6—insulating bottom plate, 7—plug column, 8—insulating enclosure, 9—mating column, 10—elastic assembly, 101—metal cap, 102—ejecting spring, 12—live-line metal connecting piece, 13—neutral-wire metal connecting piece.

DETAILED DESCRIPTION

The technical solutions according to the embodiments of the present disclosure are described in detail clearly and completely hereinafter with reference to the accompanying drawings for the embodiments of the present disclosure. Apparently, the described embodiments are only a portion of embodiments of the present disclosure, but not all the embodiments of the present disclosure. Based on the embodiments of the present disclosure, all other embodiments derived by persons of ordinary skill in the art without any creative efforts shall fall within the protection scope of the present disclosure.

Figure 2:
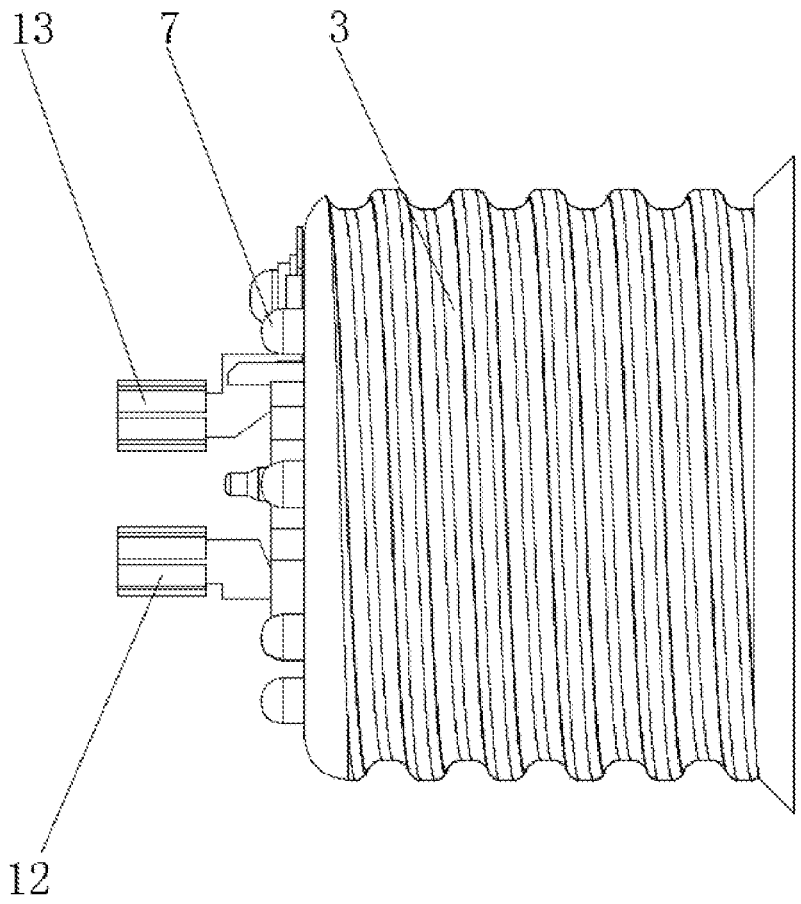
FIG. 2 is a front view of a metal inner housing with a metal piece mounted therein according the present disclosure.
Figure 3:
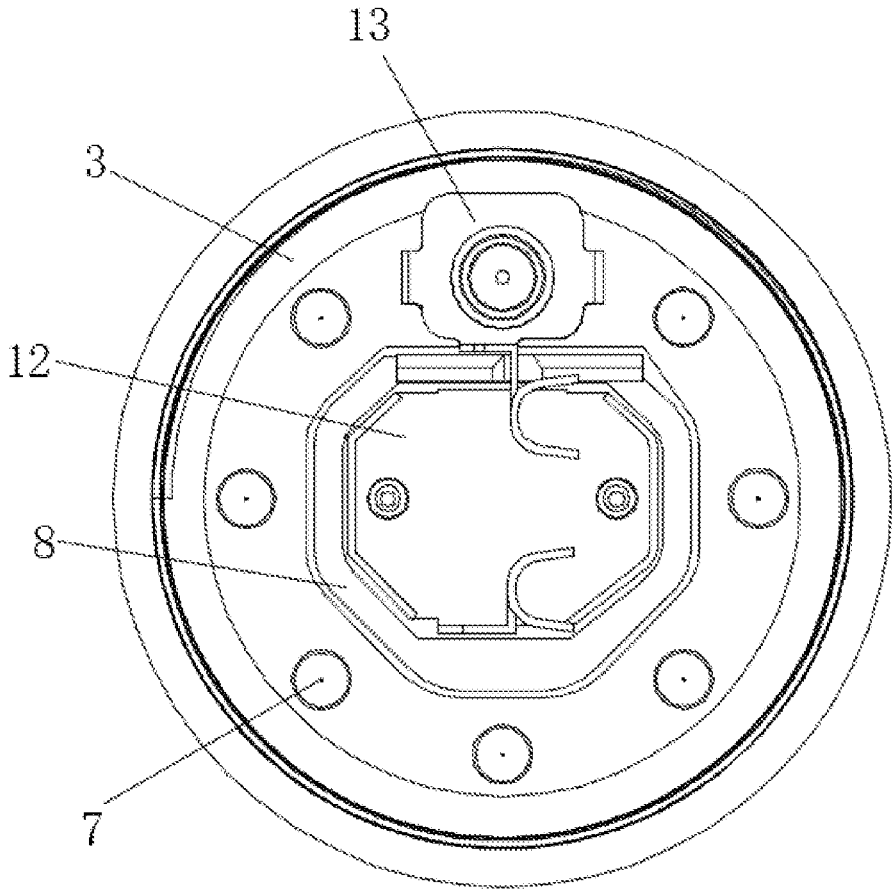
FIG. 3 is a top view of the metal inner housing with the metal piece mounted therein according to the present disclosure.
Figure 4:
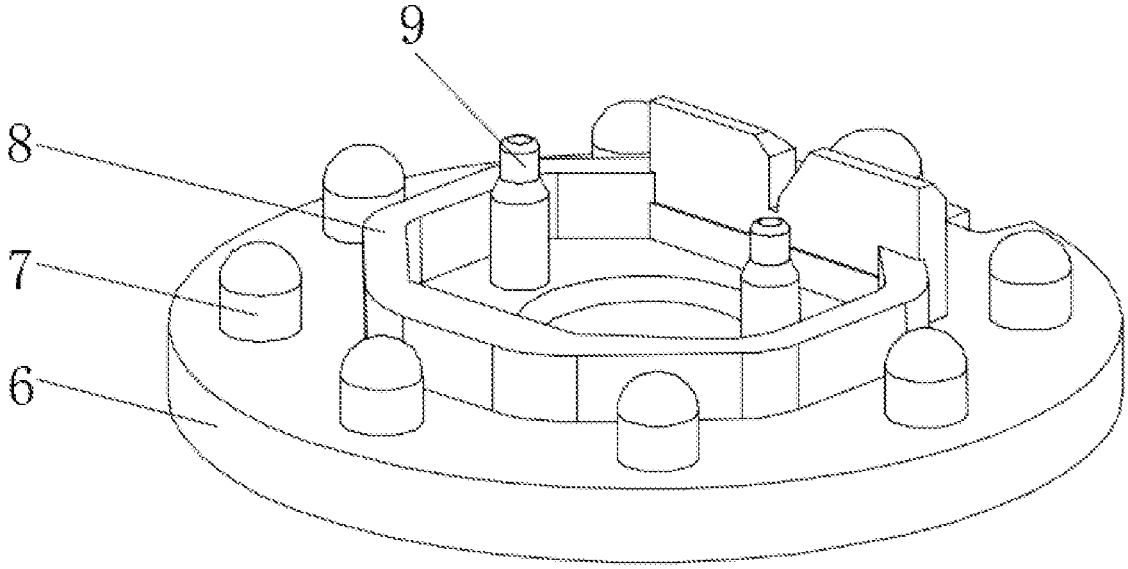
FIG. 4 is a schematic structural view of an insulating bottom plate according to the present disclosure.
Figure 5:
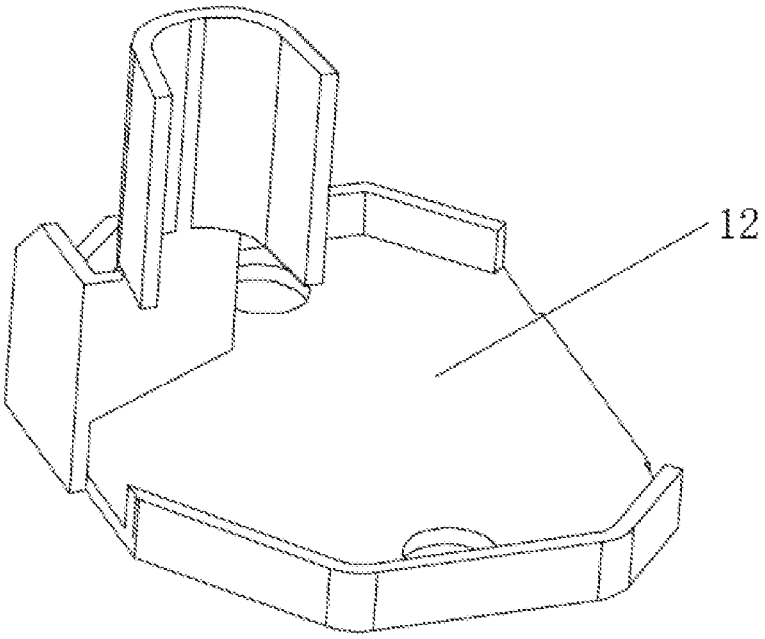
FIG. 5 is a schematic structural view of a live-wire metal connecting piece according to the present disclosure.
Figure 6:
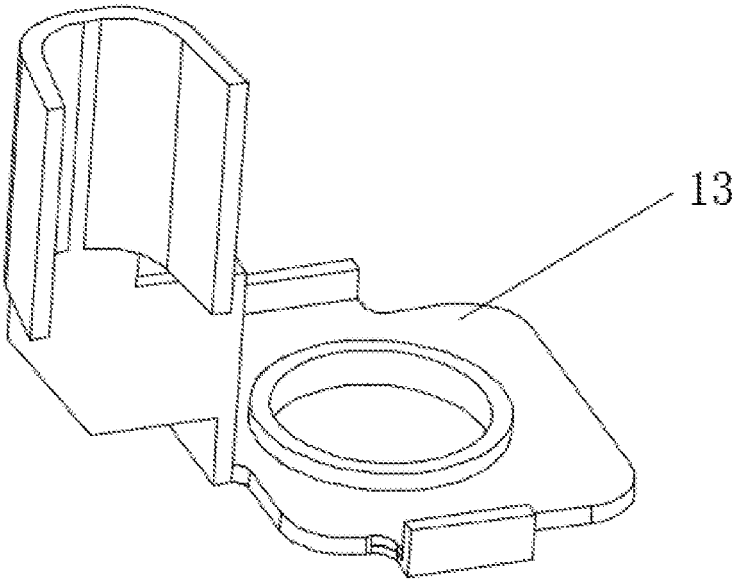
FIG. 6 is a schematic structural view of a neutral-wire metal connecting piece according to the present disclosure.
Figure 7:
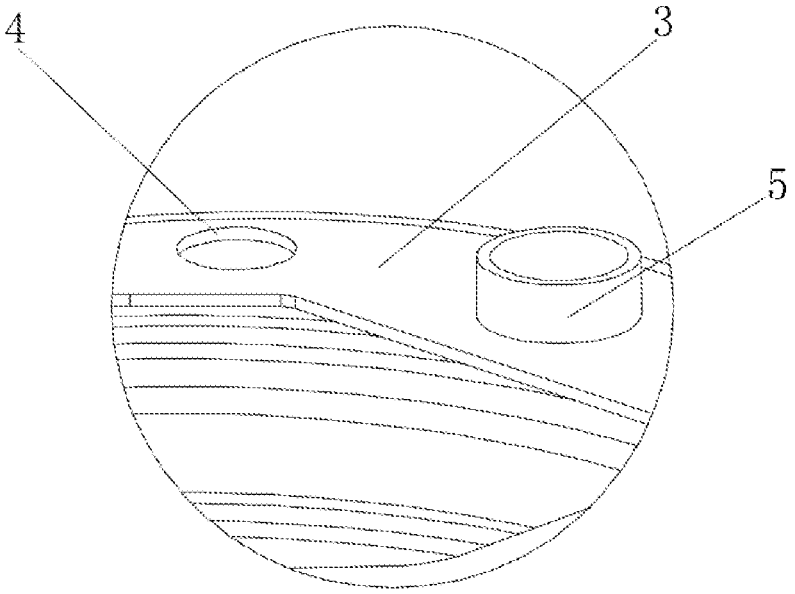
FIG. 7 is an enlarged view of part A in FIG. 1 according to the present disclosure.

An embodiment of the present disclosure provides a lamp socket structure as illustrated in FIG. 1 to FIG. 7. The lamp socket structure includes a plastic outer housing 1, a metal inner housing 3, an insulating bottom plate 6, a live-wire metal connecting piece 12, and a neutral-wire metal connecting piece 13, wherein the metal inner housing 3 is in a cylindric structure, a receiving chamber configured to receive a lamp cap is disposed inside the metal inner housing 3, a positioning chamber having a small upper portion and a large lower portion vertically runs through a top portion of the metal inner housing 3, a plurality of positioning holes 4 are disposed on an outer edge, corresponding to the positioning chamber, of the top portion of the metal inner housing 3, a via hole protruding column 5 is integrally disposed on an outer edge, corresponding to one positioning hole 4, of the top portion of the metal inner housing 3, and the neutral-wire metal connecting piece 13 is fixed to the via hole protruding column 5 by interference fitting.

The insulating bottom plate 6 is in a disc-shaped structure, an insulating enclosure 8 having a small upper portion and a large lower portion and plugged into the positioning chamber is integrally disposed in a center of a top portion of the insulating bottom plate 6, the size of an outer edge of the insulating enclosure 8 is the same as the size of an inner edge of the positioning chamber, a plurality of plug columns 7 plugged into the positioning holes 4 by interference fitting are integrally disposed in an outer edge of the top portion of the insulating bottom plate 6, and the insulating bottom plate 6 is plugged into the top portion of the metal inner housing 3.

A plug hole is disposed in a center of the insulating enclosure 8, and the insulating enclosure 8 may ensure that the live-wire metal connecting piece 12 is not in contact with the neutral-wire metal connecting piece 13, which effectively prevents the problems, such as, short circuits caused by overlapping between the live wire and the neutral wire. An elastic assembly 10 is plugged into the plug hole, and two vertical matting columns 9 are symmetrically fixed to two sides of the plug hole in the insulating enclosure 8. The live-wire metal connecting piece 12 is plugged into the two vertical matting columns 9.

Top portions of the live-wire metal connecting piece 12 and the neutral-wire metal connecting piece 13 are both integrally molded, and a riveting head is protrusively fixed to each of the top portions. The riveting head is in a U-shaped plate structure. With the riveting head, during the mounting, the wire 2 may be riveted by means of the U-shaped riveting head, which prevents the wire 2 from being secured by tin soldering, and thus prevents poor contact and wire drop at a junction of the wire 2 due to high temperature at the lamp cap. In this way, automatic riveting is implemented by machining equipment, and production efficiency is improved.

The metal inner housing 3, the insulating bottom plate 6, the live-wire metal connecting piece 12, and the neutral-wire metal connecting piece 13 constitutes a conducting base for conduction of the lamp cap, wherein the plastic outer housing 1 is mounted to the conducting base by an injection molding process.

Specifically, the plastic outer housing 1 is in a cylindric structure, and a wire 2 is mounted on a top portion of the plastic outer housing 1, wherein the wire 2 is fixed to the plastic outer housing 1 by the injection molding process, which prevents moisture permeation at the part where an electric wire runs through the housing.

Specifically, the elastic assembly 10 includes a metal cap 101 and an ejecting spring 102, and ensures a reliable circuit connection between the metal cap 101 and the live-wire metal connecting piece 12. The metal cap 101 is plugged into the plug hole, an extending chamber is opened on a top portion of the metal cap 101, the ejecting spring 102 is disposed in the extending chamber, and a top portion of the ejecting spring 102 is abutted against a bottom of the live-wire metal connecting piece 12.

Specifically, the plurality of positioning holes 4 are annularly arrayed around an axis of the metal inner housing 3, and the plurality of plug columns 7 are annularly arrayed around a point of circle of the insulating bottom plate 6.

Specifically, a thread groove mating and nesting with a mounting chamber is disposed on an outer side of the metal inner housing 3, and a female thread for threading the lamp cap is disposed in the receiving chamber.

Operating principles are as follows: during mounting of the lamp socket structure, the plug columns 7 on the insulating bottom plate 6 and the positioning holes 4 on the metal inner housing 3 are cooperatively positioned, the plug columns 7 are plugged into the positioning holes 4 by interference fitting, and hence the insulating bottom plate 6 is mounted; after the insulating bottom plate 6 is mounted, the neutral-wire metal connecting piece 13 is fixed to the via hole protruding column 5 by interference fitting, the elastic assembly 10 is mounted in the plug hole, and the live-wire metal connecting piece 12 is plugged into the insulating enclosure 8, such that the live-wire metal connecting piece 12 is fixed; after the live-wire metal connecting piece 12 is fixed, the wire 2 runs through the plastic outer housing 1, and is riveted or welded by the rivet heads on the live-wire metal connecting piece 12 and the neutral-wire metal connecting piece 13, and after being mounted, the conducting base is mounted to the plastic outer housing 1 by an injection molding process. The lamp socket structure is reasonable in design, and may prevent poor contacts at a wire junction due to high temperature at the lamp cap when the wire is mounted. Therefore, this lamp socket structure is suitable to promotion and application.

It should be finally noted that described above are exemplary embodiments of the present disclosure, which are not intended to limit the protection scope of the present disclosure. Although the present disclosure is described in detail with reference to the above embodiments, a person skilled in the art would still make modifications to the technical solution disclosed in the specific embodiments, or would still make equivalent replacements to a part of the technical features therein. These modifications, equivalent replacements, improvements, and the like shall be considered as falling within the protection scope of the present disclosure.

The invention claimed is:

1. A lamp socket structure, comprising a plastic outer housing (1), a metal inner housing (3), an insulating bottom plate (6), a live-wire metal connecting piece (12), and a neutral-wire metal connecting piece (13), wherein the metal inner housing (3) is in a cylindric structure, a receiving chamber configured to receive a lamp cap is disposed inside the metal inner housing (3), a positioning chamber having a small upper portion and a large lower portion vertically runs through a top portion of the metal inner housing (3), a plurality of positioning holes (4) are disposed on an outer edge, corresponding to the positioning chamber, of the top portion of the metal inner housing (3), a via hole protruding column (5) is integrally disposed on an outer edge, corresponding to one positioning hole (4), of the top portion of the metal inner housing (3), and the neutral-wire metal connecting piece (13) is fixed to the via hole protruding column (5) by interference fitting;

the insulating bottom plate (6) is in a disc-shaped structure, an insulating enclosure (8) having a small upper portion and a large lower portion and plugged into the positioning chamber is integrally disposed in a center of a top portion of the insulating bottom plate (6), a plurality of plug columns (7) plugged into the positioning holes (4) by interference fitting are integrally disposed in an outer edge of the top portion of the insulating bottom plate (6), and the insulating bottom plate (6) is plugged into the top portion of the metal inner housing (3);

wherein a plug hole is disposed in a center of the insulating enclosure (8), an elastic assembly (10) being plugged into the plug hole, and two vertical matting columns (9) are symmetrically fixed to two sides of the plug hole in the insulating enclosure (8), the live-wire metal connecting piece (12) being plugged into the two vertical matting columns (9);

a riveting head is integrally and protrusively fixed to both a top portion of the live-wire metal connecting piece (12) and a top portion of the neutral-wire metal connecting piece (13), the riveting head being in a U-shaped plate structure; and the metal inner housing (3), the insulating bottom plate (6), the live-wire metal connecting piece (12), and the neutral-wire metal connecting piece (13) constitutes a conducting base for conduction of the lamp cap, the plastic outer housing (1) being mounted to the conducting base by an injection molding process.

2. The lamp socket according to claim 1, wherein the plastic outer housing (1) is in a cylindric structure, and a wire (2) is mounted on a top portion of the plastic outer housing (1), the wire (2) being fixed to the plastic outer housing (1) by the injection molding process.

3. The lamp socket according to claim 1, wherein the elastic assembly (10) comprises a metal cap (101) and an ejecting spring (102), wherein the metal cap (101) is plugged into the plug hole, an extending chamber is opened on a top portion of the metal cap (101), the ejecting spring (102) is disposed in the extending chamber, and a top portion of the ejecting spring (102) is abutted against a bottom of the live-wire metal connecting piece (12).

4. The lamp socket according to claim 1, wherein the plurality of positioning holes (4) are annularly arrayed around an axis of the metal inner housing (3), and the plurality of plug columns (7) are annularly arrayed around a point of circle of the insulating bottom plate (6).

5. The lamp socket according to claim 1, wherein a thread groove mating and nesting with a mounting chamber is disposed on an outer side of the metal inner housing (3), and a female thread for threading the lamp cap is disposed in the receiving chamber.

* * * * *